US008281692B2

(12) United States Patent
Hsieh

(10) Patent No.: US 8,281,692 B2
(45) Date of Patent: Oct. 9, 2012

(54) WRENCH

(75) Inventor: Chih-Ching Hsieh, Taichung County (TW)

(73) Assignee: Chihching Hsieh, Taichung County (TW)

( * ) Notice: Subject to any disclaimer, the term of this patent is extended or adjusted under 35 U.S.C. 154(b) by 331 days.

(21) Appl. No.: 12/760,564

(22) Filed: Apr. 15, 2010

(65) Prior Publication Data

US 2011/0192261 A1 Aug. 11, 2011

(30) Foreign Application Priority Data

Feb. 8, 2010 (TW) ..... 99103831 A

(51) Int. Cl.
*B25B 23/144* (2006.01)

(52) U.S. Cl. ..... 81/479

(58) Field of Classification Search ..... 81/479
See application file for complete search history.

(56) References Cited

U.S. PATENT DOCUMENTS 4,561,332 A * 12/1985 Wood ..... 81/479
4,958,541 A * 9/1990 Annis et al. ..... 81/479
6,119,562 A * 9/2000 Jenkins ..... 81/479
6,276,243 B1 * 8/2001 Jenkins ..... 81/479
6,968,759 B2 * 11/2005 Becker et al. ..... 81/479
6,981,436 B2 * 1/2006 Becker et al. ..... 81/479
7,093,522 B2 * 8/2006 Guy et al. ..... 81/479
7,107,884 B2 * 9/2006 Cutler et al. ..... 81/479
7,367,250 B2 * 5/2008 Rainone et al. ..... 81/478
7,631,583 B2 * 12/2009 Hsieh ..... 81/467
2009/0071300 A1 * 3/2009 Rainone ..... 81/479
2010/0147119 A1 * 6/2010 Cutler ..... 81/479
2010/0170370 A1 * 7/2010 Yokoyama et al. ..... 81/479
2010/0206141 A1 * 8/2010 Nakata et al. ..... 81/479
2011/0132157 A1 * 6/2011 Duvan et al. ..... 81/479

* cited by examiner

*Primary Examiner* — David B Thomas
(74) *Attorney, Agent, or Firm* — CKC & Partners Co., Ltd.

(57) ABSTRACT

A wrench includes a hollow handle, a driver, a battery base, an alert device, a switch and a force applying device. The driver includes a drive shaft and a drive head. The drive shaft is received in the hollow handle and pivotally connected to the inner wall of the hollow handle. The drive head is connected to the drive shaft and protrudes from the hollow handle. The switch electrically connects the battery base and the alert device. The switch includes a first contact and a second contact. The first contact is located on the drive shaft. The second contact is located on the inner wall of the hollow handle. The force applying device applies a predetermined force to the drive shaft to separate the first contact and the second contact.

8 Claims, 6 Drawing Sheets

WRENCH

RELATED APPLICATIONS

The application claims priority to Taiwan Application Serial Number 99103831, filed Feb. 8, 2010, which is herein incorporated by reference.

BACKGROUND

1. Technical Field

The present invention relates to wrenches.

2. Description of Related Art

Wrench is the most widely used hand tool to lock and unload. It can be divided into ratchet wrench, socket wrench and so many types.

A wrench requires different strength when the locking device is locked on a different machine, especially a precise machine. However, the general wrench can't measure the torsion when using. It is easy to affect the safety of the machine.

SUMMARY

According to one embodiment, a wrench includes a hollow handle, a driver, a battery base, an alert device, a switch and a force applying device. The driver includes a drive shaft and a drive head. The drive shaft is received in the hollow handle and pivotally connected to the inner wall of the hollow handle. The drive head is connected to the drive shaft and protrudes the hollow handle. The switch electrically connects the battery base and the alert device. The switch includes a first contact and second contact. The first contact is located on the drive shaft. The second contact is located on the inner wall of the hollow handle. The force applying device applies a predetermined force to the drive shaft to separate the first contact and the second contact.

According to another embodiment, a wrench includes a hollow handle, a driver, a force applying device, a power device, an alert device and a switch. The driver includes a drive shaft and a drive head. The drive shaft is received in the hollow handle and pivotally connected to the inner wall of the hollow handle. The drive head is connected to the drive shaft and protrudes from the end of the hollow handle. The force applying device applies a predetermined force to the drive shaft. The power device applies electricity. The switch electrically connects the power device and the alert device. The switch includes a first contact and a second contact. The first contact is located on the drive shaft. The second contact is located on the inner wall of the hollow handle. The first contact touches the second contact when an external force overcomes the predetermined force, so that the electricity can drive the alert device.

DETAILED DESCRIPTION

In the following detailed description for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
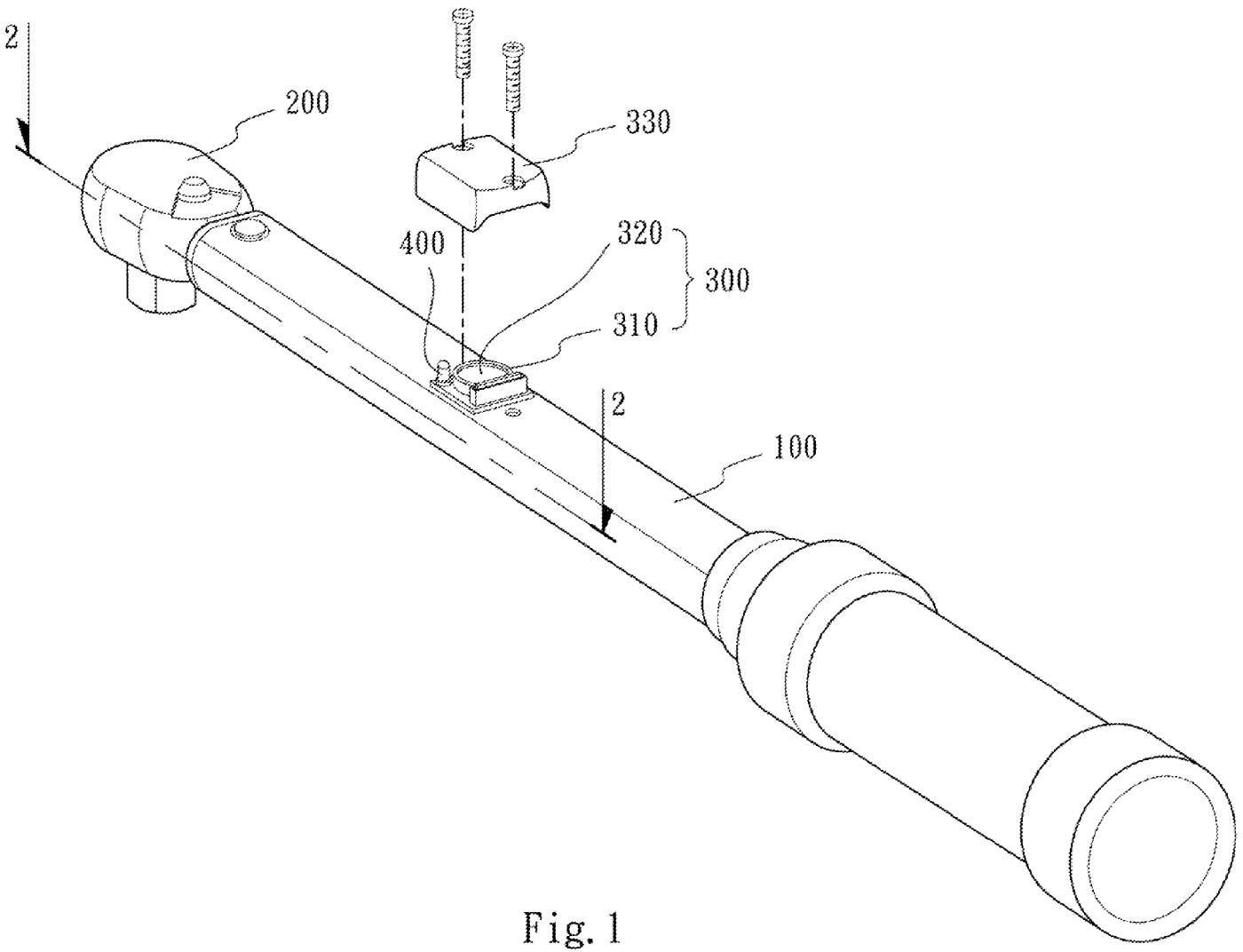
FIG. 1 is a three dimensional view of a wrench according to one embodiment.

FIG. 1 is a three dimensional view of a wrench according to one embodiment. The wrench includes a hollow handle 100, a driver 200, a power device 300, and an alert device 400. The driver 200 is received in the hollow handle 100. The power device 300 and the alert device 400 are located on the outside of the hollow handle 100. The power device 300 applies electricity. The power device 300 is a battery base 310 and the user can set a battery 320 on the battery base 310. The alert device 400 is a light emitter. The wrench further includes a cover 330. The cover 330 shelters the power device 300 and the alert device 400, so that the power device 300 and the alert device 400 can be protected.

Figure 2:
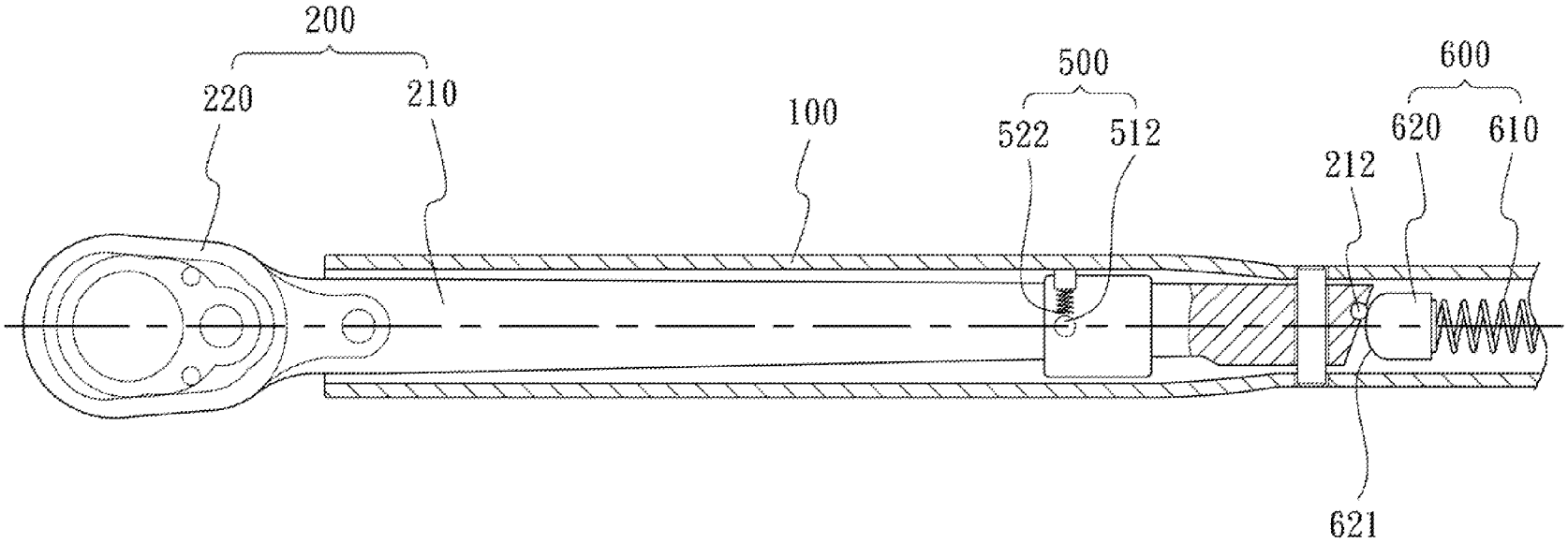
FIG. 2 is a cross-sectional view taken along line 2-2 of FIG. 1.

FIG. 2 is a cross-sectional view taken along line 2-2 of FIG. 1. The driver 200 includes a drive shaft 210 and a drive head 220. The drive shaft 210 is received in the hollow handle 100 and pivotally connected to the inner wall of the hollow handle 100. The drive head is connected to the drive shaft 210 and protrudes from the hollow handle 100.

The wrench includes a switch 500 and a force applying device 600. The switch 500 electrically connects the battery base 310 and the alert device 400. The switch 500 includes a first contact 512 and a second contact 522. The first contact 512 is located on the drive shaft 210. The second contact 522 is located on the inner wall of the hollow handle 100. The force applying device 600 applies a predetermined force to the drive shaft 210 to separate the first contact 512 and the second contact 522. In use, the user provides an external force against the hollow handle 100. The drive shaft 210 is drove by the hollow handle 100, and the drive head 220 provides torsion against a work piece. The external force leads the drive shaft 210 to shift when the external force overcomes the predetermined force of the force applying device 600. Then, the first contact 512 touches the second contact 522. Therefore, the electricity of the power device 300 flows through the switch 500, so that the electricity can drive the alert device 400. At this time, the user can be reminded that the torsion is higher than the predetermined force.

Specifically, the force applying device 600 includes an elastic member 610 and a mass 620. The elastic member 610 is a spring. One end of the elastic member 610 is connected to the hollow handle 100. The other end of the elastic member 610 is connected to the mass 620. One side of the mass 620 has a curved surface 621. One end of the drive shaft 210 is connected to a pivot pin 212. The curved surface 621 of the mass 620 applies the predetermined force against the pivot pin 212. In use, the user provides an opposite force (external force) for overcoming the predetermined force.

Figure 3:
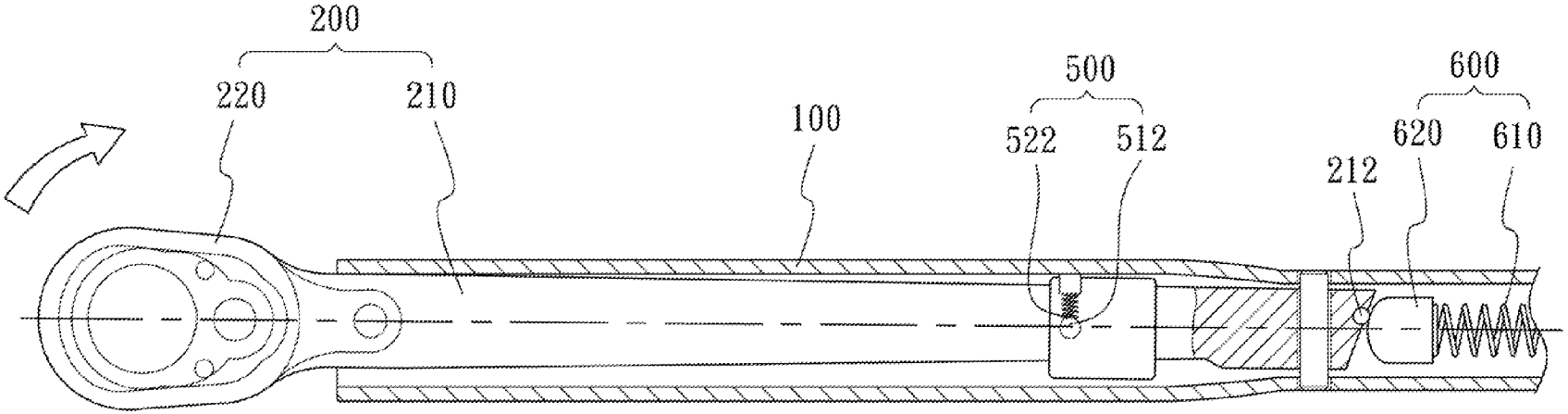
FIG. 3 is a cross-sectional view of the wrench of FIG. 1 in use.

FIG. 3 is a cross-sectional view of the wrench of FIG. 1 in use. When the external force overcomes the predetermined force, the pivot pin 212 shifts and the mass 620 can't press against the pivot pin 212. At the time, the drive shaft 210 shifts towards the inner wall of the hollow handle 100 and the first contact touches the second contact. Therefore, the alert device 400 can be driven and the user can be reminded.

Figure 4:
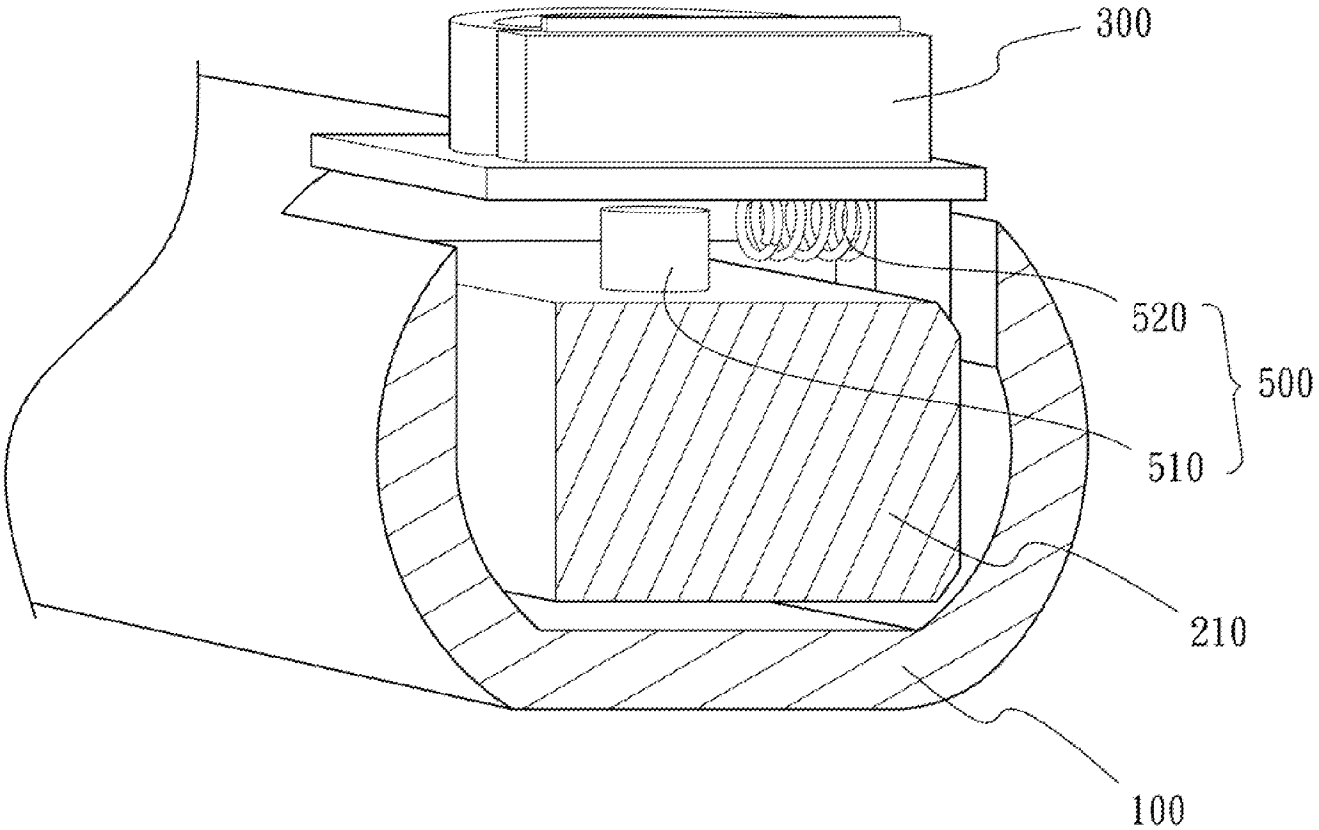
FIG. 4 is a three dimensional view of the switch of the wrench of FIG. 1.
Figure 5:
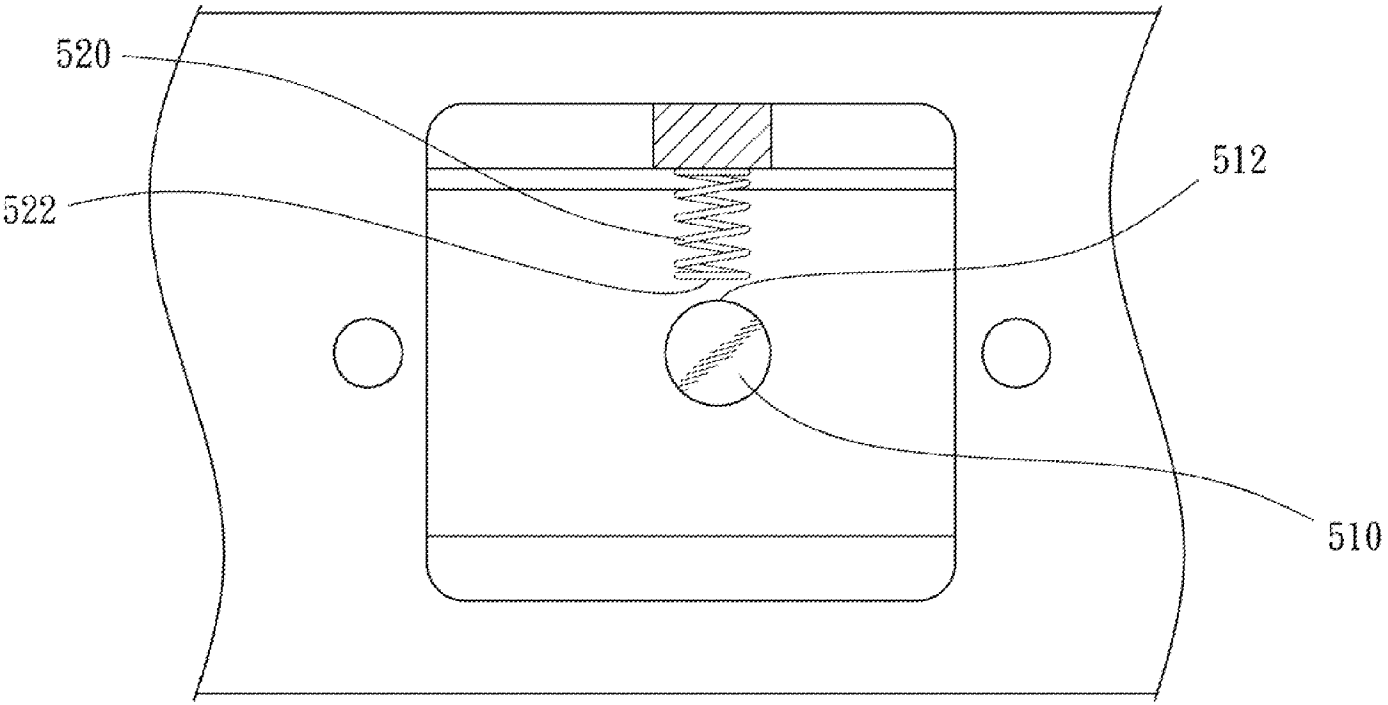
FIG. 5 is a perspective view of the wrench of FIG. 1.

FIG. 4 is a three dimensional view of the switch 500 of the wrench of FIG. 1. FIG. 5 is a perspective view of the wrench of FIG. 1. The switch 500 includes a protrusion 510 and a spring 520. The first contact 512 of the switch 500 is a protrusion 510 protruding from the driving shaft 210. The second contact 522 of the switch 500 is a spring 520 connected to the inner wall of the hollow handle 100. When the external force overcomes the predetermined force, the drive shaft 210 approaches the hollow handle 100. At this time, the protrusion 510 touches the spring 520. Therefore, the alert device 400 is driven.

Figure 6:
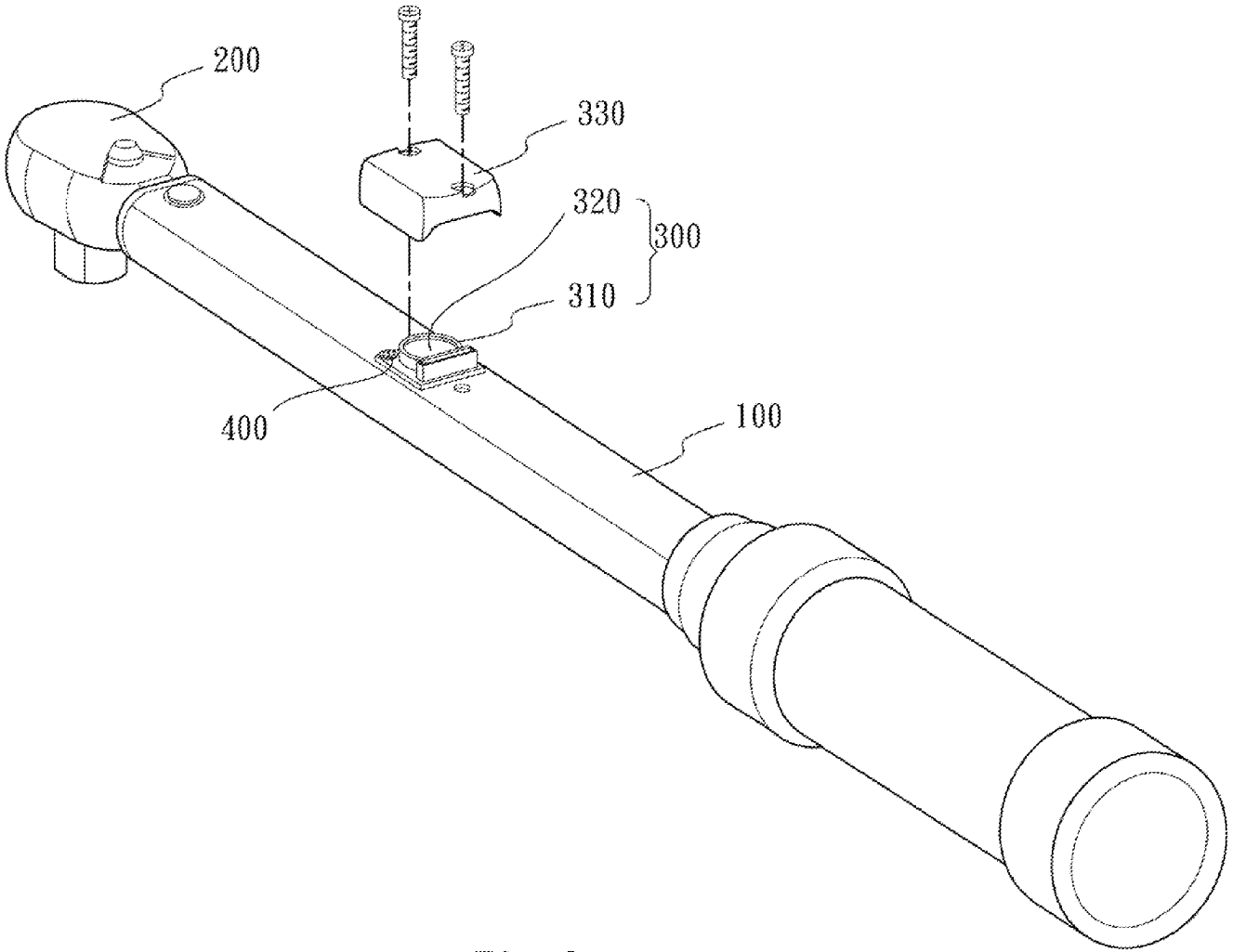
FIG. 6 is a three dimensional view of a wrench according to another embodiment.

FIG. 6 is a three dimensional view of a wrench according to another embodiment. The alert device 400 is a buzzer. When the external force overcomes the predetermined force, the buzzer can make a buzzing sound. The buzzing sound reminds that the torsion from the wrench higher than the predetermined force.

What is claimed is:

1. A wrench comprising:
- a hollow handle;
- a driver comprising:
  - a drive shaft received in the hollow handle and pivotally connected to the inner wall of the hollow handle; and
  - a drive head connected to the drive shaft and protruding from the hollow handle;
- a battery base;
- an alert device;
- a switch electrically connecting the battery base and the alert device, the switch comprising:
  - a first contact located on the drive shaft; and
  - a second contact located on the inner wall of the hollow handle, wherein the second contact of the switch is a spring connected to the inner wall of the hollow handle; and
- a force applying device for applying a predetermined force to the drive shaft to separate the first contact and the second contact.

2. The wrench of claim 1, wherein the alert device is a light emitter.

3. The wrench of claim 1, wherein the alert device is a buzzer.

4. The wrench of claim 1, wherein the force applying device is an elastic member.

5. The wrench of claim 1, wherein the first contact of the switch is a protrusion protruding from the driving shaft.

6. A wrench comprising:
- a hollow handle;
- a driver comprising:
  - a drive shaft received in the hollow handle and pivotally connected to the inner wall of the hollow handle; and
  - a drive head connected to the drive shaft and protruding from the end of the hollow handle;
- a force applying device for applying a predetermined force to the drive shaft;
- a power device for applying electricity;
- an alert device; and
- a switch electrically connecting the power device and the alert device, the switch comprising:
  - a first contact located on the drive shaft; and
  - a second contact located on the inner wall of the hollow handle, wherein the second contact of the switch is a spring connected to the inner wall of the hollow handle, and the first contact touches the second contact when an external force overcomes the predetermined force, so that the electricity can drive the alert device.

7. The wrench of claim 6, wherein the alert device is a light emitter.

8. The wrench of claim 6, wherein the alert device is a buzzer.

* * * * *